US005863347A

United States Patent [19]

Abe et al.

[11] Patent Number: 5,863,347

[45] Date of Patent: Jan. 26, 1999

[54] PICKLING METHOD OF METAL PLATE

[75] Inventors: Keizo Abe; Hiroyuki Tominaga, both of Niihama, Japan

[73] Assignee: Sumitomo Heavy Industries, Ltd., Tokyo, Japan

[21] Appl. No.: 775,299

[22] Filed: Dec. 31, 1996

[30] Foreign Application Priority Data

Feb. 8, 1996 [JP] Japan ..... 8-048332

[51] Int. Cl.[6] ..... B08B 1/02; B08B 3/08

[52] U.S. Cl. ..... 134/15; 134/16; 134/41; 29/81.03

[58] Field of Search ..... 134/9, 41, 42, 134/15, 16; 29/81.03

[56] References Cited

U.S. PATENT DOCUMENTS

| | | | |
|---|---|---|---|
| 2,666,282 | 1/1954 | Peterson | 134/16 |
| 3,924,428 | 12/1975 | Noe | 29/81.03 |
| 4,581,073 | 4/1986 | Toker et al. | 29/81.03 |
| 4,872,245 | 10/1989 | Kawasaki et al. | 29/81.03 |
| 5,131,126 | 7/1992 | Katsuki et al. | 134/15 |

FOREIGN PATENT DOCUMENTS

| | | | |
|---|---|---|---|
| 55-91983 | 7/1980 | Japan . | |
| 57-51469 | 11/1982 | Japan . | |
| 60-130414 | 7/1985 | Japan . | |
| 60-261617 | 12/1985 | Japan . | |
| 62-24814 | 2/1987 | Japan . | |
| 6-2228495 | 10/1987 | Japan | 29/81.03 |
| 40-5076923 | 3/1993 | Japan | 29/81.03 |
| 5-177238 | 7/1993 | Japan . | |

*Primary Examiner*—Harold Y. Pyon
*Assistant Examiner*—Saeed Chaudhry
*Attorney, Agent, or Firm*—Nikaido, Marmelstein, Murray & Oram LLP

[57] ABSTRACT

A pickling method which can effectively conduct pickling, and can shorten pickling time. The strip is plastic elongated by 0.1 to 10% before it is introduced into the pickling tank to form cracks. The strip is bent so that a surface strain of the strip is 0.2 to 1 times the plastic elongation during dipping the strip in the acid solution of the pickling tank, thereby making the cracks open and close, and supply of a fresh acid solution and expelling of an exhausted acid solution may be effectively conducted. Scale always contacts with a fresh acid solution by this bending operation, so that a scale dissolution reaction proceeds fast, thereby being capable of shortening the pickling time.

3 Claims, 9 Drawing Sheets

PICKLING METHOD OF METAL PLATE

BACKGROUND OF THE INVENTION

The present invention relates to a pickling apparatus and a pickling method of metal plates.

The invention is applied to typically hot-rolled carbon steel strips, hot-rolled stainless steel strips, hot-rolled silicon steel strips, and the like. (Hereinafter, such strip is merely referred to as "strip".) However, the present invention is not limited to such strips.

One example of conventional pickling apparatus is shown in FIG. 9 (conventional example I). Example I comprises a tension leveler and/or a skin pass mill as a scalebreaker 6, arranged at an inlet side of a pickling tank 10. Such arrangement is intended that a strip S is given with a plastic elongation by the scalebreaker 6 to provide the scale with cracks, so that the scale is easily dissolved into an acid solution when the strip is dipped in the acid solution. In FIG. 9, reference numerals 1, 2 and 3 denote a pickling tank, respectively, 4 a rinsing tank, and 5 a dryer.

However, example I has the problems that, since the acid solution merely enters into cracks of scale autoconvectionally during dipping in each of the pickling tanks 1 to 3, a necessary amount of hydrochloric acid does not enter into the cracks sufficiently, to dissolve the scale so as to make the dissolution reaction considerably slow resulting in a long pickling time.

JP-A-55-91983 (corresponding to JP-B2-57-51469) teaches another example (conventional example II). Referring to FIG. 10, the example II equipment comprises bending rolls 54, 55, 56 and 57 arranged zigzag in a pickling tank 1, wherein a strip S is passed through the pickling tank while bending the strip in an acid solution.

However, in example II, as shown in FIG. 11, the strip S, with scale layers a, in a linear state 1 is introduced into the pickling tank 1 and cyclically bent between a bent state m and a linear state n as shown in FIG. 11. Although the acid solution enters into cracks b of the scale a in the bent state m, once the strip S varies from the bent state m to the linear state n, the cracks b are closed and the acid solution between those are pushed to flow out from the cracks b. As a result, the dissolution reaction stops at that time. Thus, the conventional example II also has the problem that the pickling process requires much time.

SUMMARY OF THE INVENTION

In view of the above circumstances, an object of the present invention is to provide a pickling apparatus and a pickling method, which can accelerate dissolution reaction of scale by effectively bringing a metal base of a strip into contact with an acid solution so that a pickling time can be shortened.

According to one aspect of the present invention, there is provided a pickling apparatus comprising a scalebreaker by which a strip is provided with a plastic elongation and which is arranged at an inlet side of a pickling tank; and a bending apparatus which is arranged in the pickling tank and by which the strip is bent in acid solution in the pickling tank.

The pickling tank may comprise a plurality of tanks connected in series. The bending apparatus may be disposed in a first tank in which the strip is first dipped. The bending apparatus may be also disposed in at least one of the tanks.

A concentration of the acid solution in the first tank may be higher than those in the downstream side tanks.

The bending apparatus may comprise deflector rolls and work rolls, which are disposed at the both opposite sides of the strip so as to be in contact with the both surfaces of the strip, respectively; and an intermesh adjusting mechanism by the work rolls are adjusted in those height level with respect to the deflector rolls to vary a bending degree of the strip.

The intermesh adjusting mechanism may comprise lifting cylinders by each of which the work roll is moved in its height level, and each of which piston rod is connected with the work roll; upper limitation stoppers by each of which an upper limitation of the connecting rod is variably determined; and lower limitation stoppers by each of which a lower limitation of the connection rod is variably determined.

According to another aspect of the present invention, there is provided a pickling method, comprising subjecting a metal strip to plastic working to providing it with an elongation of 0.1 to 10%, subsequently introducing the strip into a pickling tank containing an acid solution, and subjecting the strip to bending working during dipping in the acid solution so that a surface strain of the strip is 0.2 to 1 time of the above plastic elongation.

PREFERRED EMBODIMENT OF THE INVENTION

Now, the description will be made of embodiments of the present invention with reference to the drawings.

Figure 1:
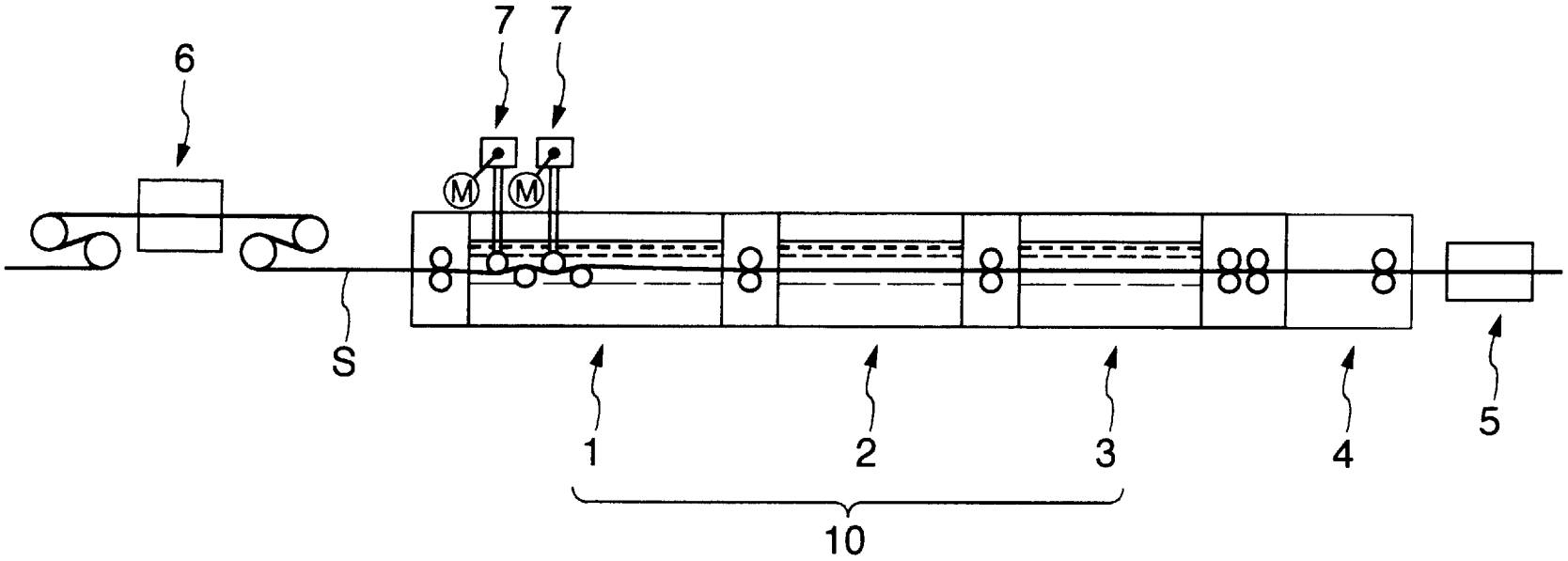
FIG. 1 is a general side view of a pickling apparatus according to one embodiment of the present invention.
Figure 2:
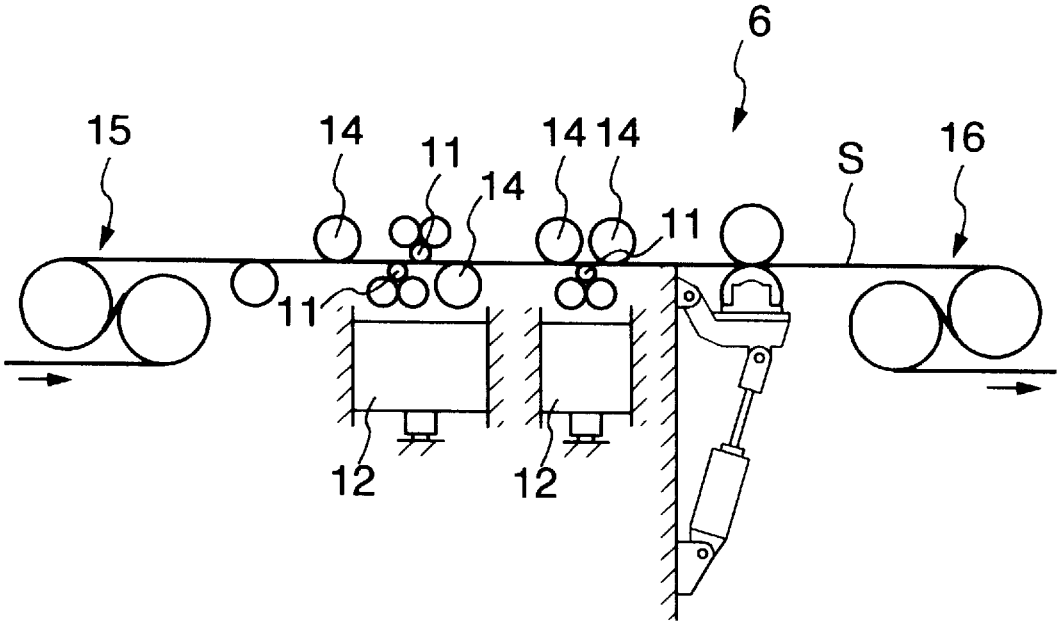
FIG. 2 is a schematic side view of a scale-breaker.

In FIG. 1, reference numeral 10 denotes a pickling apparatus which comprises a first pickling tank 1, a second pickling tank 2, a third pickling tank 3, a rinsing tank 4 arranged at a downstream side of the third pickling tank 3 and a drier 5 arranged at an outlet side of the pickling apparatus. The number of pickling tanks is not limited to three as shown in FIG. 1, and may be one, two, four or more. A scalebreaker 6 is arranged at an inlet side of the pickling tank 10, which comprises a tension leveler and a skin pass mill. In the scale-breaker 6 as one example shown in FIG. 2, several work rolls 11 are arranged between bridle rolls 15, 16 with an interval in a pass line direction, and are supported by backup rolls. Deflector rolls 14 are arranged before and behind the work rolls in the pass line 11. Reference numerals 12 denote a lifting mechanism by which a pressure by the work roll 11 to a strip S is adjustable.

Figure 5:
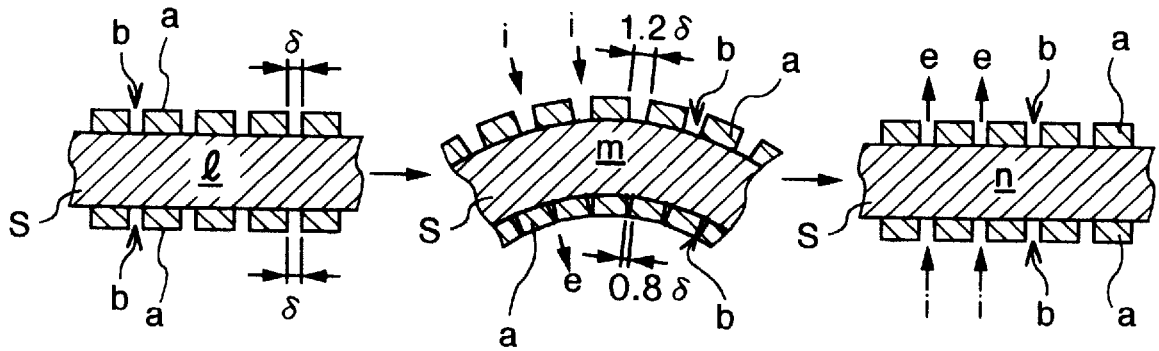
FIG. 5 is a schematic view illustrating a dissolution reaction of scale.

In the scalebreaker 6, if the work rolls 11 are adjusted to project by an appropriate degree over the reference running plane of the strip S, which is defined by the deflector rolls 14, while applying tension to the strip S with the bridle rolls 15, 16, the body of the metal strip is elongated, but the scale a on the surface layer of the strip is not elongated resulting in occurrence of cracks b (see the state 1 in FIG. 5).

Figure 3:
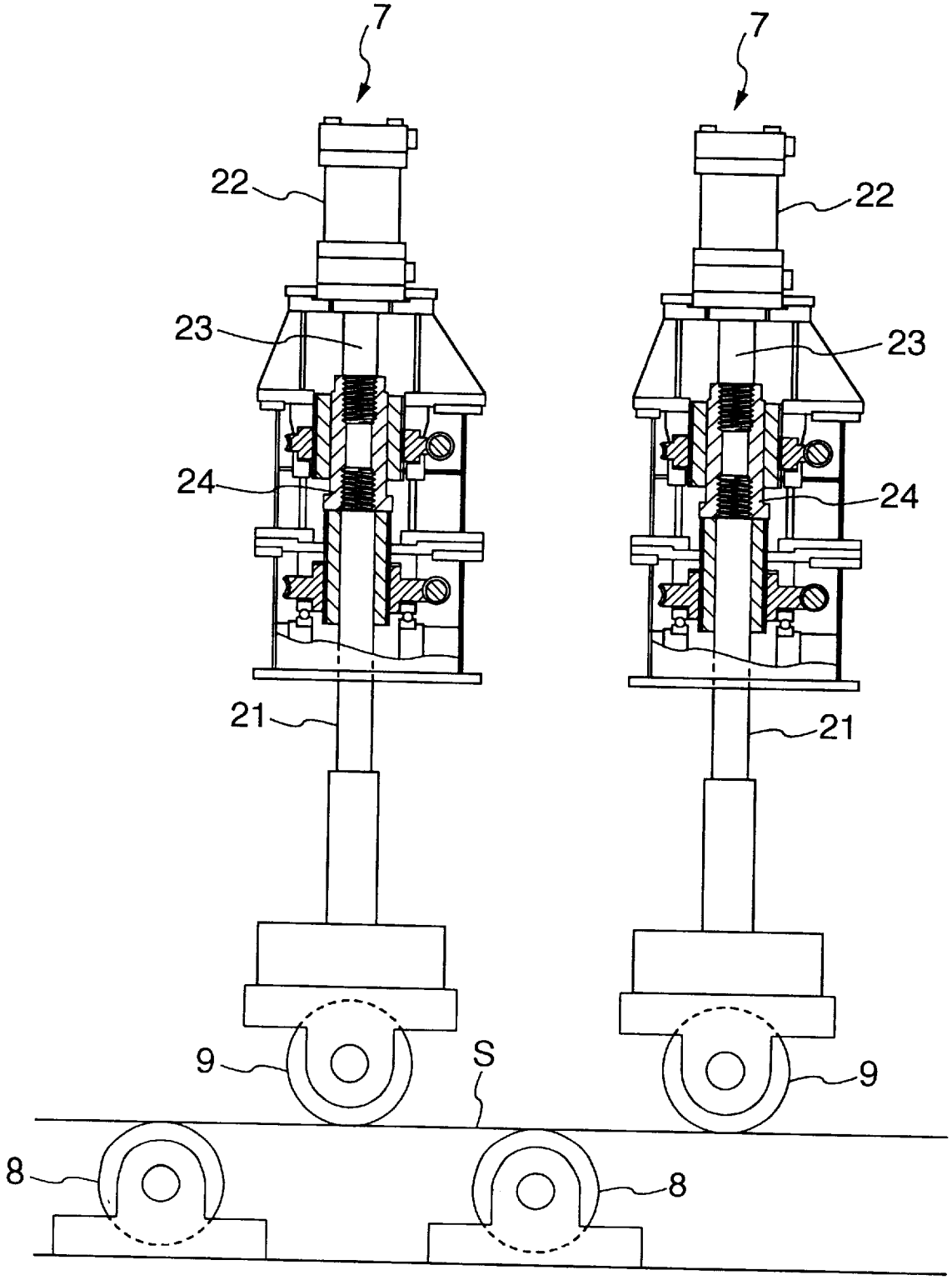
FIG. 3 is a partially cross-sectioned side view of a bending apparatus.
Figure 4:
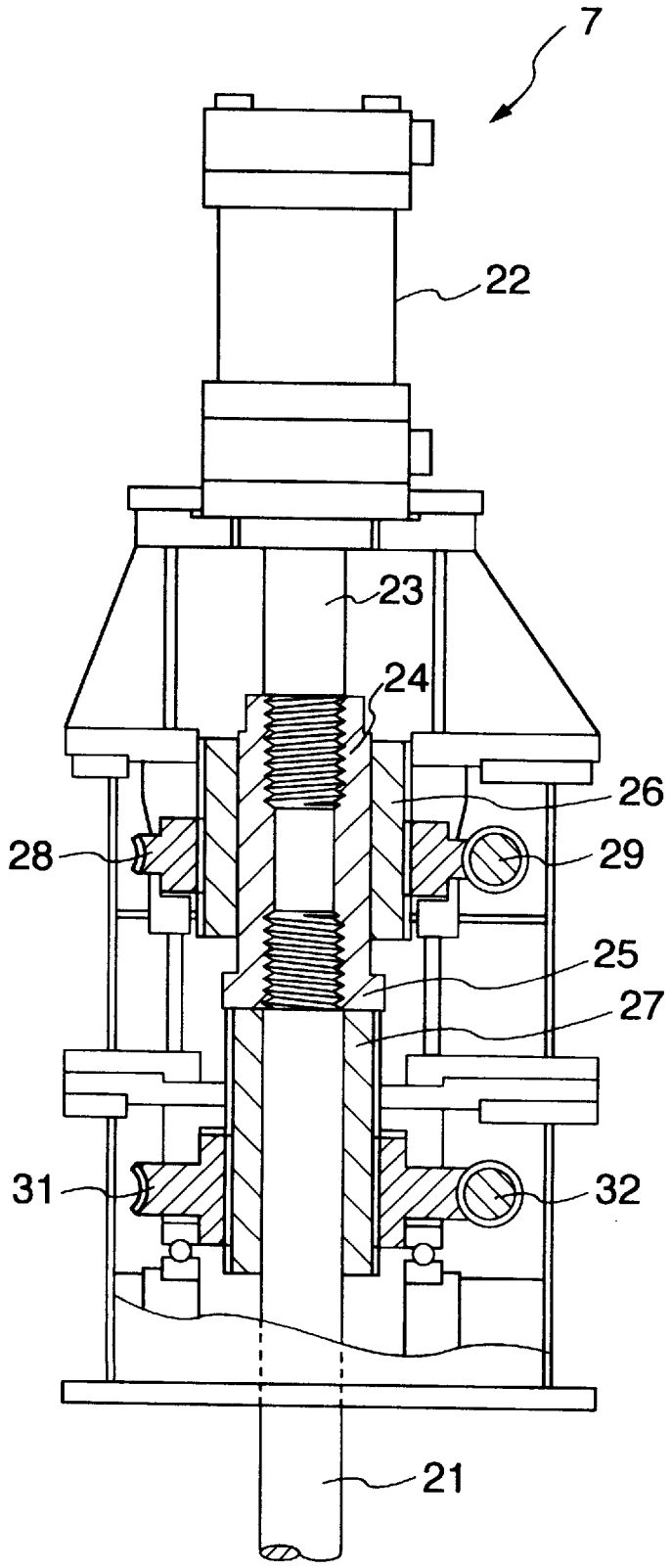
FIG. 4 is a partially cross-sectioned view of an essential portion of an intermesh adjusting mechanism.

Two bending apparatus 7 are arranged in the first tank 1 of the pickling tank 10 shown in FIG. 1. The bending apparatus 7 is explained in detail with reference to FIGS. 3 and 4.

Reference numeral 8 denotes a deflector roll, and 9 denotes a work roll. They are arranged so as to hold the strip S therebetween. A rod 21 is coupled to the work roll 9, and is also connected to a piston rod 23 of a lifting cylinder device 22 comprising a hydraulic cylinder with a connecting rod 24. A flange 25 is formed on the connecting rod 24. An upper limit stopper 26 is fitted slidably up and down onto the outer periphery of the connecting rod 24 above the flange 25, and a lower limit stopper 27 is fitted slidably up and down onto the outer periphery of the rod 21 below the flange 25. A male thread is formed on the outer periphery of the upper limit stopper 26, and meshes a worm wheel 28 having a female thread formed on the inner surface thereof. When a worm 29 is rotated by a motor (not shown) to rotate the worm wheel 28, the upper limitation stopper vertically moves, thereby being capable of changing its setting position. The lower limitation stopper 27 is similarly constituted such that it is vertically by the worm wheel 31 and the worm 32 so as to change its position.

With the above constitution, when the lifting cylinder device 22 is operated so that the rod 21 moves upwardly and downwardly, the work roll 9 also moves upwardly and downwardly, so that an intermesh amount (overlap in height or strip-bending degree) to the deflector roll 8 can be quickly adjusted. Further, the intermesh amount can be precisely adjusted by changing the setting position of the upper and lower limit stoppers 26, 27.

The above-described intermesh adjusting mechanism has the advantage that pressing-down (or strip-bending) and release operations can be quickly conducted, but such a mechanism is not limited to the intermesh adjusting mechanism, and any adjusting mechanism such as a worm jack apparatus may be employed.

Next, the description is made on the pickling method according to the embodiment of the present invention by referring to FIGS. 1 and 5.

First, the strip S is elongated with the scalebreaker 6 so that plastic elongation $\epsilon_0$ of the strip S is 0.1 to 10%. The plastic elongation $\epsilon_0$ used herein means a ratio of elongation of a distance between two points in pass line direction after scalebreaker treatment to that before scalebreaker treatment, and is expressed by $\epsilon_0=(L'-L)/L$, wherein L is a distance between two points before scalebreaker treatment, and L' is a distance between two points after scalebreaker treatment.

When the strip S is elongated, the cracks b may be generated on the scale a on the surface of the strip, as described above and shown in FIG. 5 (state l).

Subsequently, when the strip S enters into a first tank 1 of the pickling tank 10, the strip S is bent with the bending apparatus 7 while the strip is dipped in an acid solution. In this case, intermesh between the work roll 9 and the deflector roll 8 is adjusted so that a surface strain of the strip S is 0.2 to 1 time of the above-mentioned plastic elongation. Here, the surface strain means a strain of a strip surface generated when bending the strip S, and is expressed by $\epsilon'=t/2\sigma$, wherein $\sigma$ is a radius of curvature (mm), and t is a strip thickness (mm).

Under the bent state, as described above, the outside of the strip S elongates $\epsilon'$, and the inside of the strip S shrinks $\epsilon'$.

To obtain desired surface strain, it is sufficient to change the radius of curvature $\sigma$ by the work roll 9. To this end, it is also sufficient to change the intermesh amount of the work roll 9 to the deflector roll 8 by lifting the lifting cylinder 22.

In FIG. 5, when the ratio of the bending surface strain $\epsilon'$ to the plastic elongation $\epsilon_0$, that is, $\epsilon'/\epsilon_0=0.2$, if a gap between the cracks b on the strip S in a linear state is $\delta$ (see state l), the gap $\delta$ at the outside of the bent region when strip is bent expands 1.2 times, and the gap $\delta$ at the inside of the bent region shrinks 0.8 times. By the expansion and shrinkage actions of the gap $\delta$, a fresh acid solution is introduced in the cracks b at the outside, and an acid solution after reaction is expelled from the cracks b at the inside. Further, when $\epsilon'/\epsilon_0=1$, the gap $\delta$ at the inside of the bent region is 2 times, and the gap $\delta$ at the inside of the bent region is zero. In other words, all the acid solution in the cracks b at the inside is expelled, and when the strip returns to a linear state thereafter, the cracks allow the acid solution to enter again. Therefore, it is not necessary to bend the strip such that $\epsilon'/\epsilon_0$ is more than 1. If $\epsilon'/\epsilon_0$ is less than 0.2, the introducing and expelling effects of the acid solution become small, which is undesirable. Therefore, the preferred range of $\epsilon'/\epsilon_0$ is from 0.2 to 1.

In the pickling apparatus shown in FIG. 1, bending is applied to the front and back surfaces of the strip S with two bending apparatus 7 every one time. In this case, as shown in FIG. 5 (state m), a fresh acid solution is introduced into the cracks b at the outside of the bent region (see "i"), and reacted acid solution is expelled from the cracks b at the inside of the bent region (see "e"). Next, when the bending is reversed, introduction and expelling of the acid solution are conducted at the opposite sides, respectively. Further, as shown in FIG. 5 (state n), when the bent strip returns to a linear state, introduction "i" and expelling "e" are conducted reversely as compared with the state immediately before bending. Thus, in the present invention, the acid solution is positively introduced in or expelled from the cracks b generated by plastic elongation with the scalebreaker 6, by the bending action of the bending apparatus 7. Therefore, the dissolution reaction always proceeds with a fresh acid solution, and, consequently, the pickling operation can be efficiently conducted within a short time.

Bending applied to the strip S in the acid solution is at least one time. The number of contact of the strip to a fresh acid solution increases as the number of bending increases, and the pickling time can be shortened. However, since the pickling is completed with a certain number of bending, it is not necessary to increase the number of bending more than the necessary time. The necessary number of bending, that is, the number of the bending apparatus 7 may be appropriately selected depending on a material of the strip, a strip thickness, a scale thickness, and the like.

Figure 7:
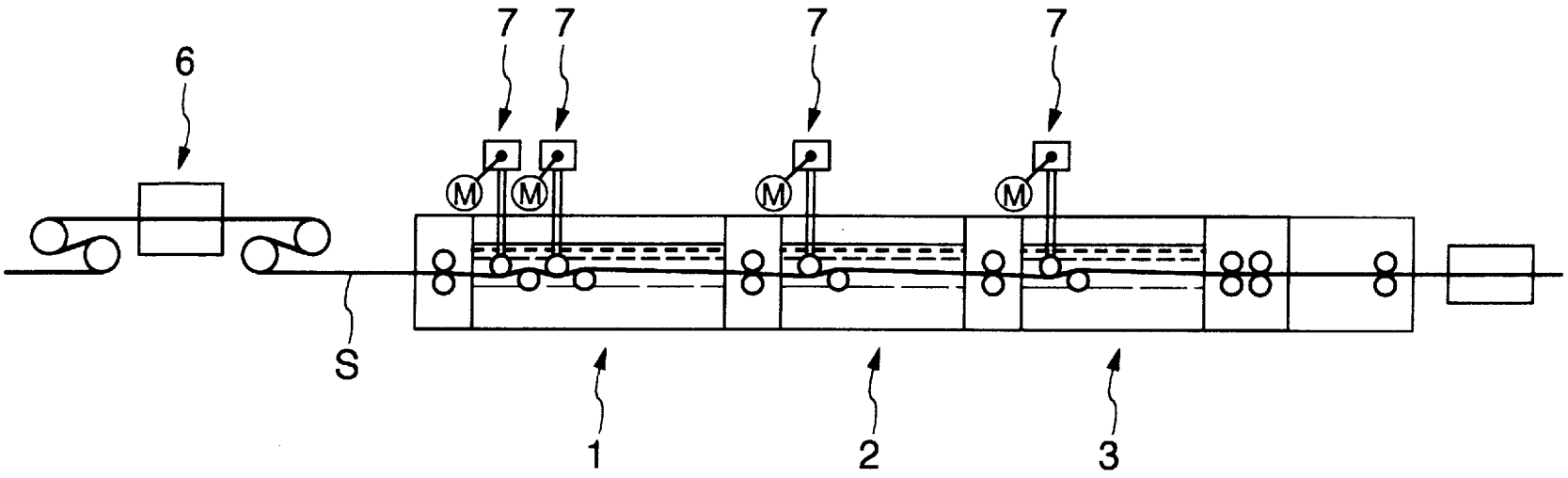
FIG. 7 is a general side view of a pickling apparatus according to another embodiment of the present invention.

The pickling apparatus shown in FIG. 7 is another embodiment according to the present invention. Two bending apparatus 7 are arranged in the first tank 1 of the pickling tank 10, one bending apparatus 7 is arranged in the second tank 2 of the pickling tank 10, and one bending apparatus 7 is arranged in the third tank 3 of the pickling tank 10, respectively. With this constitution, the bending of the strip S in the acid solution is conducted two times for the front and back surfaces, respectively.

Figure 8:
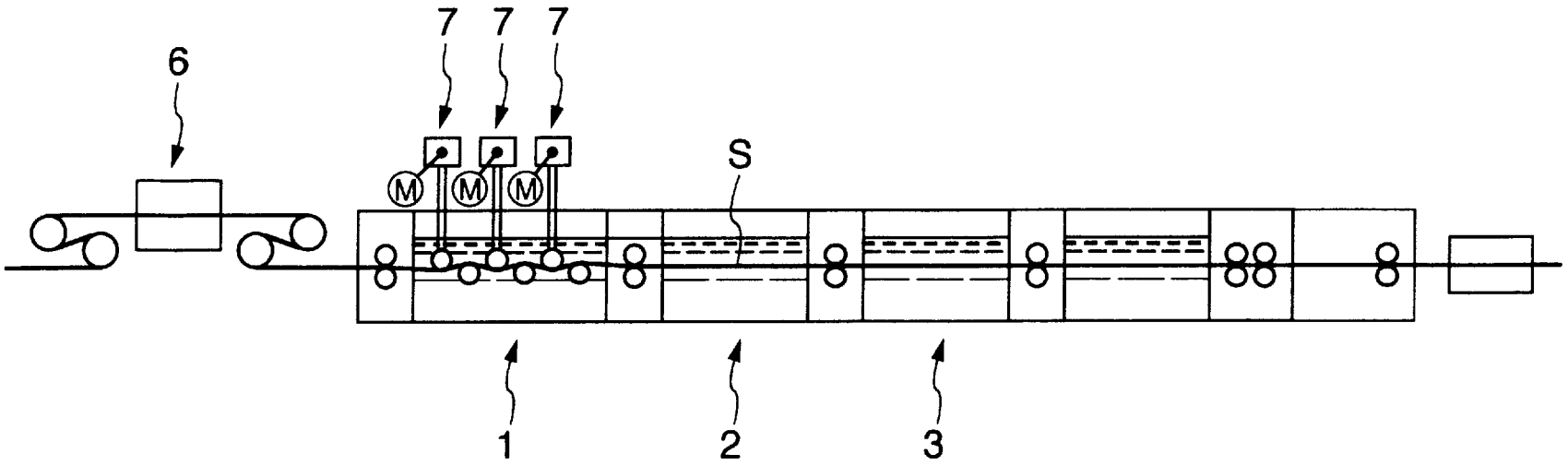
FIG. 8 is a general side view of a pickling apparatus according to still another embodiment of the present invention.
Figure 9:
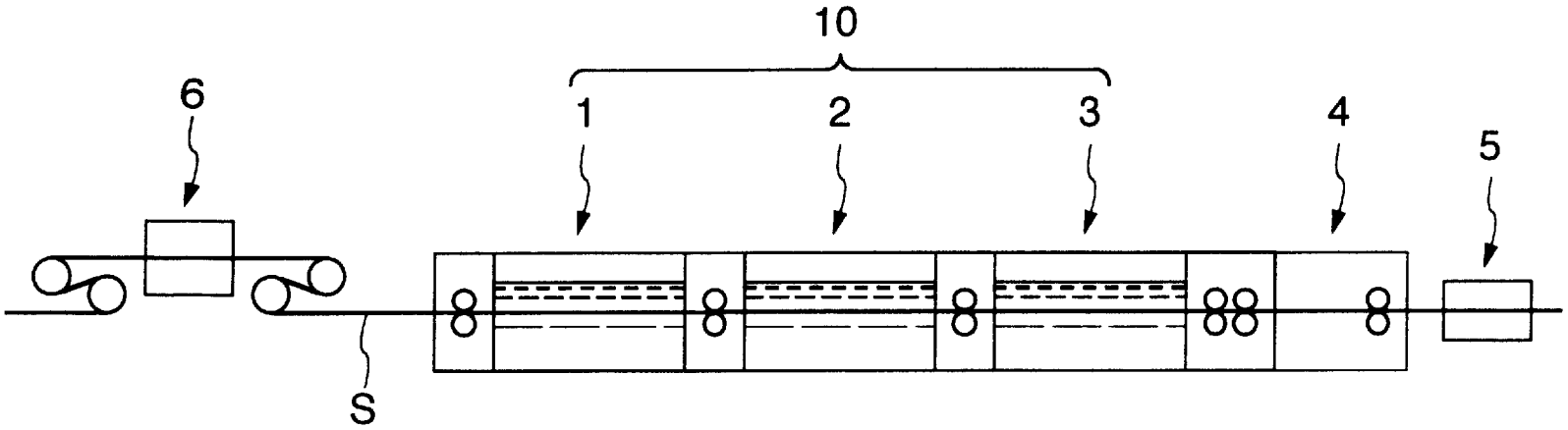
FIG.9 PRIOR ART
FIG. 9 is a general side view of a pickling apparatus of conventional Example I.
Figure 10:
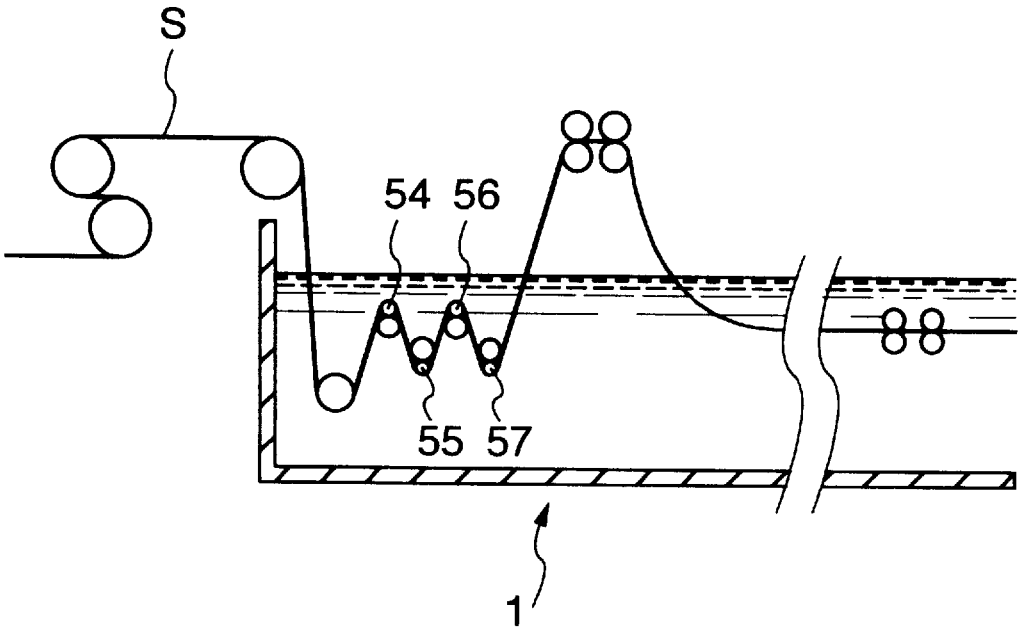
FIG.10 PRIOR ART
FIG. 10 is a cross-sectional side view of an essential portion of a pickling apparatus according to conventional Example II.
Figure 11:
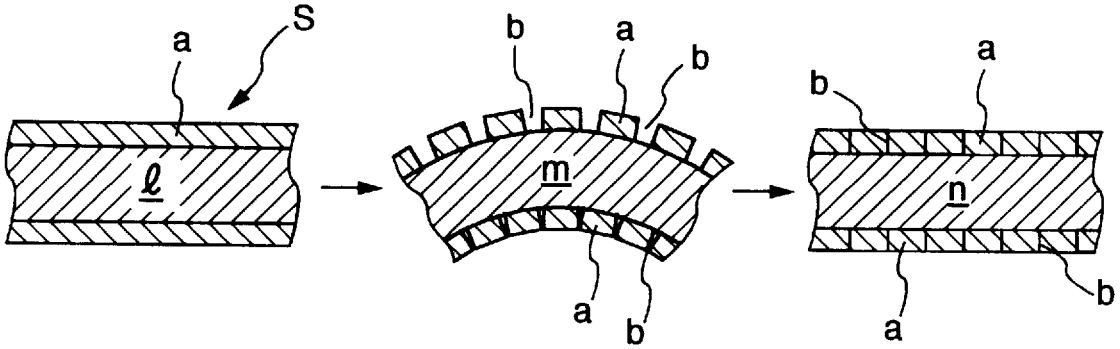
FIG.11 PRIOR ART
FIG. 11 is a schematic view illustrating a problem in conventional Example II.

The pickling apparatus shown in FIG. 8 is still another embodiment according to the present invention. Three bending apparatus 7 are arranged in the first tank 1 of the pickling tank 10. In this case, the concentration of the acid solution in the first tank 1 is higher (for example, 15%) than those in the succeeding tanks in order to improve pickling efficiency. In usual, the concentration of the acid solution is typically 1 to 3% in a first tank and typically 3 to 10% in succeeding tanks.

The pickling apparatus shown in FIGS. 1, 7 and 8 are mere examples. Any arrangements not described and shown herein can be used in the present invention so long as they fall within the scope of the present invention.

EXAMPLE

Figure 6:
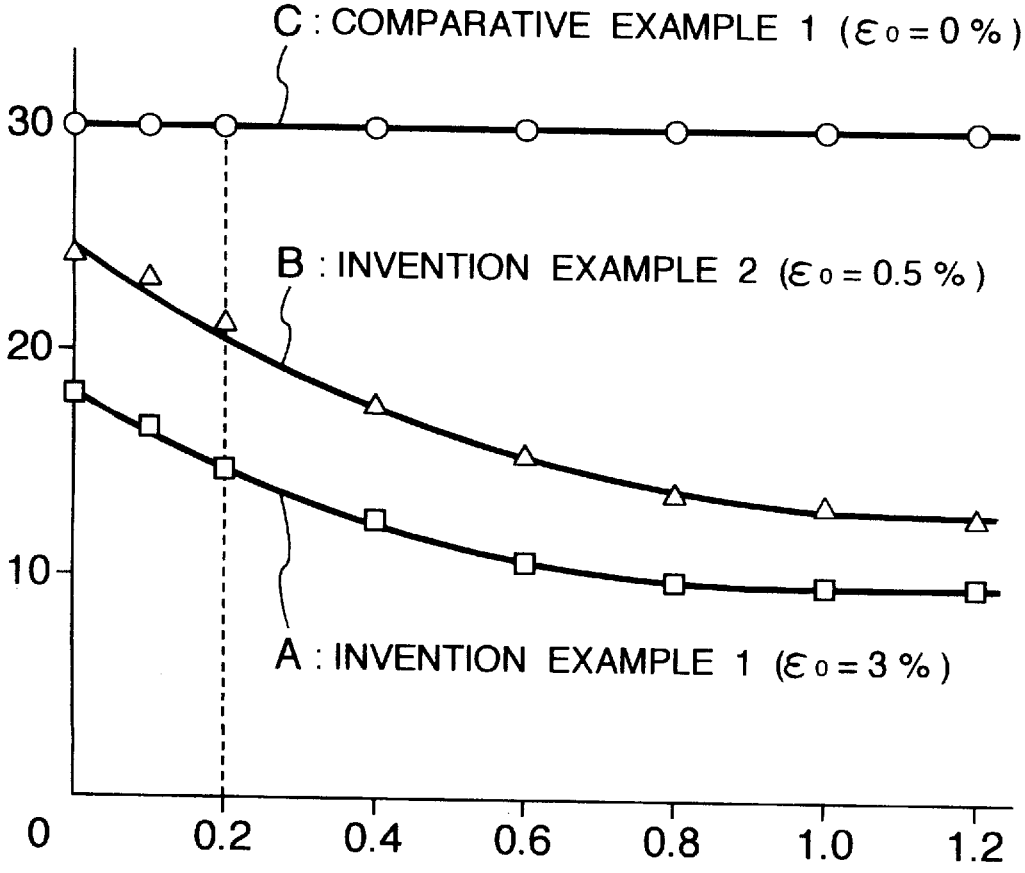
FIG. 6 is a graph showing a result of a scale dissolution test.

FIG. 6 is a graph showing test results of the pickling apparatus and the pickling method according to the present invention.

The test method is as follows. The pickling apparatus shown in FIG. 7 was used, and bending was applied to the front and back surfaces of the strip S in the acid solution every two times. The concentration of the acid solution was 7% in each of the tanks 1, 2 and 3. A material of the strip was a hot-rolled low carbon steel strip, and a thickness of the strip was 2.3 mm.

A strip having the plastic elongation $\epsilon_0$=3% given by the scalebreaker 6 was used in Example 1, a strip having $\epsilon_0$=0.5% was used in Example 2, and a strip having $\epsilon_0$=0%, that is, no plastic elongation was used in Comparative Example 1. The ratio of a bending surface strain $\epsilon'$ to the plastic elongation $\epsilon_o$ was divided into six grades between zero and 1.2, and a pickling time was measured for each strip.

The results obtained are shown in FIG. 6. Line A shows the results obtained in Example 1, line B shows the results obtained in Example 2, and line C shows the results obtained in Comparative Example 1. It is apparent from the results obtained in Comparative Example 1 that the pickling time is not shorten at all, and there was obtained no effect by the bending in the acid solution if the plastic elongation before pickling was not conducted. On the other hand, the strips used in Examples 1 and 2 are subjected to plastic elongation, and the pickling time of the strip of Example 1 having a large plastic elongation $\epsilon_0$ is shorter than that of Example 2. It is believed that this means that the cracks b become large as the plastic elongation $\epsilon_0$ increases, whereby the contact area of the cracks to the acid solution increases. Further, the pickling time shortens as the ratio of the surface strain $\epsilon'$ by bending it in the acid solution to the plastic elongation $\epsilon_0$ increases. From this, it is believed that the degree of opening of the cracks b and the expelling effect of the acid solution are remarkable as much as the bending is large, whereby exchange of a fresh acid solution and the reacted acid solution are effectively conducted.

As will be apparent from the above, according to the embodiments of the present invention, the following advantages can be obtained.

Since a fresh acid solution can be supplied to cracks previously formed on a scale layer, dissolution reaction proceeds fast, thereby being capable of shortening the pickling time. Thus, length of the pickling tank can be shortened, thereby decreasing costs for facilities, and if the length of the pickling tank is the same as that of the conventional pickling tank, speed of a strip pass line can be increased, thereby increasing productivity.

According to the present invention, since pressing-down amount of the work roll to the deflector roll can be freely adjusted, a surface strain suitable to a thickness of the strip can be applied to the strip, supply of the acid solution into cracks and squeeze thereof from cracks by bending can be optimum, and pickling can be effectively conducted.

Further, according to the present invention, since the work roll can be vertically moved with the lifting cylinder device, movement of the work roll can quickly be conducted, thereby decreasing loss time. Further, the setting positions of the work rolls can be exactly determined by the upper and lower limitation stoppers, and since the position is freely adjusted, adjustment of the intermesh can exactly and easily be performed.

What is claimed is:

1. A pickling method comprising the steps of subjecting a metal strip to plastic working to provide it with an elongation of 0.1 to 10%, subsequently introducing said strip into a pickling tank containing an acid solution, and subjecting said strip to bending working during dipping in the acid solution so that a surface strain of the strip is 0.2 to 1 times said plastic elongation.

2. A pickling method according to claim 1, wherein said pickling tank consists of a plurality of pickling tank sections through which the metal strip is caused to pass, and wherein the concentration of the acid solution in a first pickling tank section is higher than those in the succeeding pickling tank sections, said first pickling tank section being positioned at the entrance side of the metal strip.

3. A pickling method according to claim 1, wherein the metal strip is of a hot-rolled steel strip.

* * * * *